US005906532A

United States Patent [19]

Nakajima et al.

[11] Patent Number: 5,906,532

[45] Date of Patent: May 25, 1999

[54] METHOD FOR POLISHING SEMICONDUCTOR SUBSTRATE AND APPARATUS FOR THE SAME

[75] Inventors: Tsutomu Nakajima; Yoshihiro Hayashi, both of Tokyo, Japan

[73] Assignee: NEC Corporation, Tokyo, Japan

[21] Appl. No.: 08/504,011

[22] Filed: Jul. 19, 1995

[30] Foreign Application Priority Data

Aug. 10, 1994 [JP] Japan ..... 6-188146

[51] Int. Cl.[6] ..... B24B 41/06

[52] U.S. Cl. ..... 451/41; 451/285; 451/287; 451/289; 451/388

[58] Field of Search ..... 451/41, 283, 285, 451/287, 288, 289, 388, 397, 398, 402

[56] References Cited

U.S. PATENT DOCUMENTS

| | | | |
|---|---|---|---|
| 3,579,916 | 5/1971 | Boettcher | 451/288 |
| 4,466,852 | 8/1984 | Beltz et al. . | |
| 4,519,168 | 5/1985 | Cesna . | |
| 4,521,995 | 6/1985 | Sekiya . | |
| 4,625,463 | 12/1986 | Sekiya | 451/388 |
| 5,423,716 | 6/1995 | Strasbaugh | 451/289 |

FOREIGN PATENT DOCUMENTS

| | | |
|---|---|---|
| 475338 | 3/1992 | Japan . |
| 530052 | 5/1993 | Japan . |
| 5154760 | 6/1993 | Japan . |
| 5277908 | 10/1993 | Japan . |
| 6224165 | 8/1994 | Japan . |

OTHER PUBLICATIONS

European Examination Report under Section 18(3), dated Dec. 9, 1997.

*Primary Examiner*—Eileen P. Morgan
*Attorney, Agent, or Firm*—Whitham, Curtis & Whitham

[57] ABSTRACT

The method for polishing a semiconductor substrate includes the steps of (a) forming a flowing liquid layer between a semiconductor substrate and a substrate holder to thereby support the semiconductor substrate therebetween by surface tension of the flowing liquid layer, and (b) compressing the semiconductor substrate onto a polishing cloth including process liquid therein. The method ensures that a semiconductor substrate is not damaged at a reverse surface thereof and also that a semiconductor substrate is not contaminated by particles contained in process liquid, because the flowing liquid layer prevents particles of process liquid from entering between the semiconductor substrate and the substrate holder.

14 Claims, 3 Drawing Sheets

METHOD FOR POLISHING SEMICONDUCTOR SUBSTRATE AND APPARATUS FOR THE SAME

BACKGROUND OF THE INVENTION

1. Field of the Invention

The invention relates to a method for polishing a semiconductor substrate and an apparatus for the same, and more particularly to a method for chemically and mechanically polishing a semiconductor substrate and an apparatus for the same.

2. Description of the Related Art

In order to fabricate a semiconductor integrated circuit including a multi-interconnection layer in which a plurality of interconnection layers are arranged in three dimensions, it is necessary to flatten surfaces of interlayer insulative layers (silicon oxide layers) disposed between multi-interconnection layers. Namely, when a silicon oxide layer is deposited by CVD subsequent to the formation of aluminum interconnection layers on a first layer or a lowermost layer, the aluminum interconnection layers cause irregularities on a surface of the deposited silicon oxide layer. When second aluminum interconnection layers are to be patterned on the silicon oxide layer having such irregularities in a photolithography step and a dry etching step, the irregularities pose such problems that focus for exposure of resist patterning is not able to be adjusted and that residue of dry etching remains at steps of the irregularities. Thus, Japanese Patent Publication No. 5-30052 has suggested that such irregularities present on a surface of an interlayer insulative layer are removed by polishing to thereby flatten the surface. Specifically, the Publication has suggested the method including the steps of supplying process liquid to a polishing cloth lying on a rotatable surface table, and compressing a silicon substrate onto the polishing cloth to thereby remove the irregularities present on an interlayer insulative layer. The polishing of a silicon oxide layer is accomplished by both a chemical etching function of silicon oxide and a mechanical function caused by friction between the irregularities and abrasive particles. Japanese Unexamined Patent Public Disclosure No. 4-75338 has suggested the use of process liquid comprising ammonia aqueous solution containing, as abrasive particles, silica particles having a diameter of approximately 40 nm in the range of 10 wt % to 30 wt %.

In polishing to remove micron order irregularities present on an interlayer insulative layer, a structure of a substrate holder in a polishing apparatus is quite important for carrying out uniform polishing within a substrate. For instance, if irregularities are present on a surface of such a substrate holder, uniformity of polishing a substrate would be degraded, even if such irregularities are minute. Alternatively, if particles exist between a substrate holder and a reverse surface of a substrate, such particles cause polishing speed of an interlayer insulative layer to locally change, even if such particles are of micron order. In addition, a substrate may be damaged at a reverse surface thereof by contact with a substrate holder. Thus, how a substrate is held exerts a great influence on the flattening of a surface of a thin layer, which constitutes a semiconductor, including a polysilicon layer and a metal layer as well as an interlayer insulative layer There have been the following four conventional methods A to D for holding a substrate.

A. In method A, as illustrated in FIG. 1A, a substrate 1 is fixedly adhered to a substrate holder 13 through an adhesive 14 such as hot melt wax. The substrate 1 adhered to the substrate holder 13 is compressed onto a polishing cloth 9 lying on a surface table 10, and then a rotation shaft 8 rotates the substrate holder 13 and hence the substrate 1 on the polishing cloth 9. Thus, a surface of the substrate 1 is polished to thereby remove irregularities present on the surface of the substrate 1. For instance, such a method A has been suggested in Japanese Unexamined Patent Public Disclosure No. 5-154760 laid open on Jun. 22, 1993, and Japanese Unexamined Patent Public Disclosure No. 6-224165, laid open on Aug. 12, 1994, which is based on U.S. patent application Ser. No. 07/961565 filed on Oct. 15, 1992 and assigned to Applied Materials Incorporated.

B. In method B, as illustrated in FIG. 1B, the substrate 1 is sucked to the substrate holder 13 by a vacuum pump 17 through a hole 3 formed in the substrate holder 13. Thus, the substrate 1 is polished on the polishing cloth 9 with the substrate 1 being vacuum-sucked to the substrate holder 13. For instance, such a method B has been suggested in Japanese Unexamined Patent Public Disclosure No. 5-277908, laid open on Oct. 26, 1993, which is based on U.S. patent application Ser. No. 07/826,394 filed on Jan. 27, 1992 and assigned to Micron Technology Incorporated, and also in the above mentioned Japanese Unexamined Patent Public Disclosure No. 6-224165.

C. In method C, as illustrated in FIG. 1C, a pad 15 which contains water is attached to the substrate holder 13 at its bottom surface, and a guide ring 4' is fixedly secured to the substrate holder 13 at its periphery. The substrate 1 is compressed onto the polishing cloth 9 to thereby remove irregularities with being held in position by surface tension of water contained in the pad 15.

D. In method D, as illustrated in FIG. 1D, the substrate holder 13 is provided with the pad 15 and the guide ring 3. While the substrate 1 is held in position by surface tension of water contained in the pad 15, a pump 18 applies pressurized air 16 (backing pressure) to the substrate 1 though the hole 3 of the substrate holder 13 to thereby prevent deformation of the pad 15. The substrate 1 is compressed onto the polishing cloth 9 to thereby remove irregularities thereof in the same way as the above mentioned methods A to C.

However, the above-mentioned conventional methods have problems as follows.

First, the method A, in which the substrate 1 is fixed to the substrate holder 13 by the adhesive 14 as illustrated in FIG. 1A, additionally requires the steps of applying the adhesive 14 to a reverse surface of a substrate to be polished, and cleansing and removing the adhesive 14 from the substrate 1. Thus, the method A is not suitable to a semiconductor fabrication process which requires mass-productivity, for instance, in a step for flattening an interlayer insulative layer.

In the method B illustrated in FIG. 1B, abrasive particles may be attracted to the reverse surface of the substrate 1 and enter between the reverse surface of the substrate 1 and the substrate holder 13 while the substrate is being polished, and such abrasive particles deteriorate the flatness of a polished surface of the substrate 1. In addition, since the substrate 1 makes direct contact with the substrate holder head 13, the substrate 1 may be damaged at its reverse surface.

In the method C, in which the pad 15 and the guide ring 4' is secured to the substrate holder 13 as illustrated in FIG. 1C, the pad 15 may be deformed in long use with the result that the flatness of a polished substrate is degraded and hence uniformity of polishing is also degraded. Further, while polishing, the substrate 1 may exert a stress on the guide ring 4'. In general, the adhesive 14 does not have water-resistance, and hence the guide ring 4' tends to peel off from the substrate holder 13. If alkaline slurry is to be used as process liquid, the guide ring 4' is more likely to peel off.

In the method D, in which the substrate holder 13 and the pad 15 are formed with the through hole 3, as illustrated in FIG. 1D, through which the substrate 1 is vacuum-chucked while the substrate 1 is being transferred, and through which the air 16 is applied to the pad 15 to prevent deformation of the pad 15 while the substrate 1 is being polished, it is relatively easy to automate securing the substrate 1 to the substrate holder 13 and releasing the substrate 1 from the substrate holder 13. However, since the reverse surface of the substrate 1 is kept in contact with the air 16 while the substrate 1 is being polished, the reverse surface of the substrate 1 tends to become dry, and hence slurry of process liquid reaching the reverse surface of the substrate 1 is prone to become dry and stick to the reverse surface of the substrate 1. In addition, even if the deformation of the pad 15 is prevented by the air 16 while polishing, the pad 15 is worn out in long use. Thus, it is impossible to avoid local deformation of the pad 15.

SUMMARY OF THE INVENTION

In view of the foregoing problems of the prior methods, it is an object of the present invention to provide a method and an apparatus for polishing a semiconductor substrate, not having the foregoing problems. More specifically, it is an object of the present invention to provide both a method and an apparatus in which the pad is not used.

In one aspect, the invention provides a method for polishing a semiconductor substrate, including the steps of (a) forming a flowing liquid layer between a semiconductor substrate and a substrate holder to thereby support the semiconductor substrate therebetween by surface tension of the flowing liquid layer, and (b) compressing the semiconductor substrate onto a polishing cloth including process liquid therein.

In a preferred embodiment, the flowing liquid layer is formed by providing pure water containing no solid between the semiconductor substrate and the substrate holder.

In another preferred embodiment, the flowing liquid layer is formed by providing an aqueous solution of an electrolyte containing no solid between the semiconductor substrate and the substrate holder.

In still another preferred embodiment, the flowing liquid layer is formed by providing an organic solvent containing no solid between the semiconductor substrate and the substrate holder.

In yet another preferred embodiment, the method further includes the step of (c) rotating the substrate holder and hence the semiconductor substrate on the polishing cloth, the step (c) being carried out subsequently to the step (b).

In still yet another preferred embodiment, the step (a) includes the step of forming a plurality of liquid flows, each of which originates from a point spaced away from an edge of the semiconductor substrate.

The invention further provides a method for polishing a semiconductor substrate, including the steps of (a) vacuum-chucking a semiconductor substrate at a reverse surface thereof to a substrate holder, (b) providing process liquid into a polishing cloth lying on a surface table disposed in facing relation to a surface of the semiconductor substrate, (c) compressing the semiconductor substrate onto the polishing cloth, (d) stopping vacuum-chucking of the semiconductor substrate almost simultaneously with the step (c), and (e) providing liquid to thereby form a flowing liquid between the semiconductor substrate and the substrate holder, almost simultaneously with the step (d), thereby supporting the semiconductor substrate between the substrate holder and the semiconductor substrate by surface tension of the flowing liquid layer.

In another aspect, the invention provides an apparatus for polishing a semiconductor substrate, including (a) a substrate holder for holding a semiconductor substrate therewith, the substrate holder being formed with at least one through holes reaching a surface thereof, the semiconductor substrate functioning to hold the surface of the substrate holder, (b) a surface table disposed in facing relation to the substrate holder, (c) a polishing cloth lying on the surface table, and (d) a device for selectively providing vacuum or liquid onto the surface of the substrate holder through the through holes.

In a preferred embodiment, the device is a three-way valve.

In another preferred embodiment, the device is designed to provide vacuum onto the surface of the substrate holder while the semiconductor substrate is being transferred, and provide liquid while the semiconductor substrate is being polished.

In still another preferred embodiment, the apparatus further includes a motor for rotating the semiconductor holder and hence the semiconductor substrate.

In yet another preferred embodiment, the liquid is selected from pure water containing no solid, an aqueous solution of electrolyte containing no solid, such as ammonia salts, and an organic solvent containing no solid, such as glycerine. The liquid may be selected from a weak acidic aqueous solution such as acetate, dilute nitric acid, dilute hydrochloric acid and dilute sulfuric acid, and a weak alkaline aqueous solution such as dilute aqueous ammonia and aqueous solution of amine.

In still yet another preferred embodiment, the substrate holder is formed with a plurality of through holes, each of which reaches the surface of the substrate holder at a point spaced away from an edge of the semiconductor substrate.

In, further preferred embodiment, the apparatus further includes a guide ring having an inner diameter slightly greater than an outer diameter of the semiconductor substrate, the guide ring being bonded to the substrate holder and surrounding the semiconductor substrate. It is preferable for the guide ring to be composed of rigid polymer such as acrylics, polystyrene, Teflon and vinyl chloride.

In a still further preferred embodiment, the apparatus further includes a film composed of resilient material, the film being interposed between the substrate holder and the guide ring. The resilient material is preferably selected from silicon rubber, natural rubber and synthetic rubber.

In yet a further preferred embodiment, the guide ring is formed at a bottom surface thereof with at least one radially extending groove.

In still yet further preferred embodiment, the surface of the substrate holder is composed of inorganic material. The inorganic material includes single crystal silicon, sapphire, diamond, quartz, glass, sintered aluminum oxide, and sintered silicon nitride.

The advantages obtained by the aforementioned present invention will be described hereinbelow.

In the method in accordance with the invention, since an adhesive is not used for attaching a semiconductor substrate to a substrate holder, there are no required steps of applying an adhesive to a reverse surface of a substrate to be polished, and washing to remove an adhesive from a substrate. In addition, since the method in accordance With the invention does not use a pad to be attached to a reverse surface of a substrate, there is no degradation of the flatness of a semiconductor substrate due to deformation of a pad. Furthermore, since the method in accordance with the invention forms a flowing liquid layer along a reverse surface of a substrate, slurry never becomes dry and thus never sticks to a reverse surface of a substrate. Thus, polishing uniformity is not deteriorated.

In addition, since the guide ring is indirectly bonded to the substrate holder, the guide ring does not peel off the substrate holder even if a substrate exerts a stress on the guide ring. Between the guide ring and the substrate holder is disposed a film composed of resilient material, and hence the guide ring is slightly movable. Thus, even if a momentarily exerts a great stress on the guide ring, the film lightens the stress and hence the guide ring is never broken.

In the method in accordance with the invention, a semiconductor substrate is polished with a flowing liquid layer being present between the substrate holder and a reverse surface of the semiconductor substrate. Hence, the substrate can easily rotate within the guide ring, resulting in that uniformity of polishing a semiconductor substrate is enhanced.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to the attached drawings.

Figure 2A:
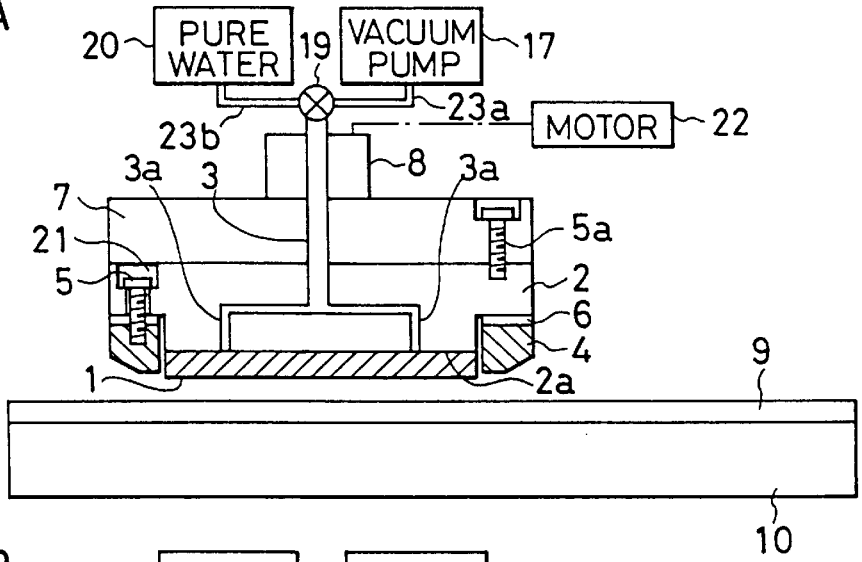
FIGS. 2A, 2B and 2C are cross-sectional views of the apparatus for polishing a semiconductor substrate in accordance with the invention.
Figure 2B:
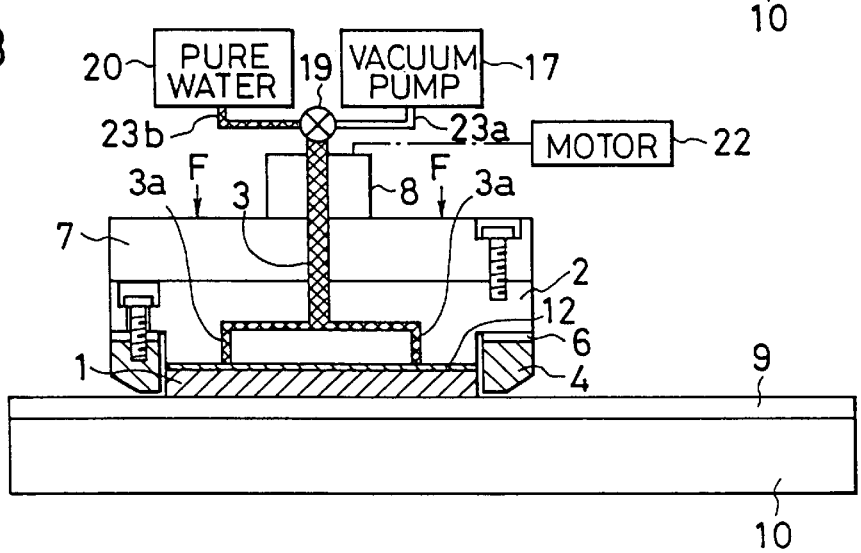
Figure 2C:
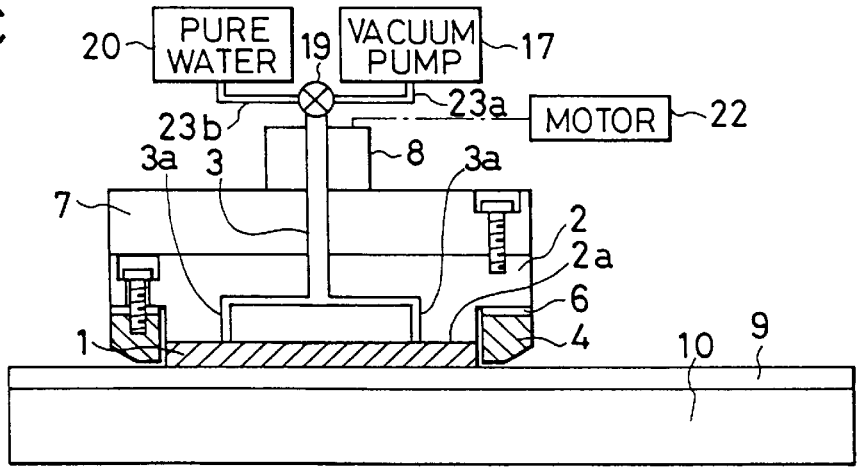

FIGS. 2A to 2C illustrate an embodiment in accordance with the invention for polishing interlayer insulative layers (not illustrated) such as $SiO_2$ and layers deposited on a single crystal silicon substrate 1 on which elements such as transistors are mounted.

Figure 3:
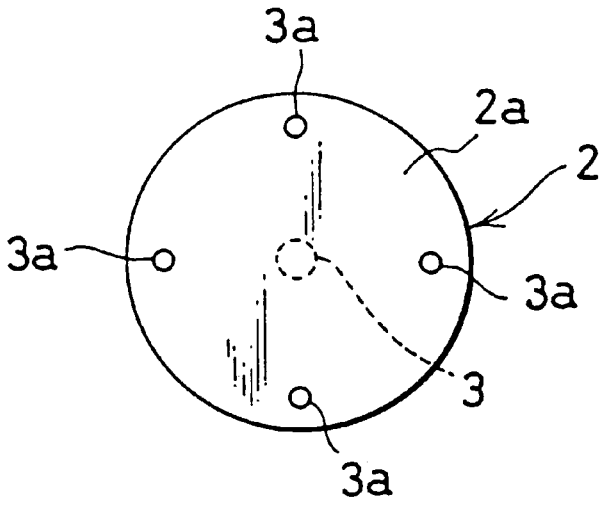
FIG. 3 is a plan view of the substrate holder in which the divisional holes open, as viewed from a bottom surface thereof.

As illustrated in FIG. 2A, a substrate holder 2 composed of quartz is formed with a through hole 3 at its central axis dividing into a plurality of holes 3*a* in the substrate holder 2. Each of the divisional holes 3*a* reaches a surface 2*a* of the substrate holder 2 at a point spaced away from an edge of the substrate 1. As illustrated in FIG. 3, there are formed four divisional holes 3*a* arranged in a circle about the through hole 3, and the four divisional holes 3*a* are circumferentially, evenly spaced away from one another. The through hole 3 is in communication with a vacuum pump 17 via a three-way valve 19. The through hole 3 is also in communication with a reservoir 20 via the three-way valve 19. The reservoir 20 contains pure water having no solids therein. Thus, by switching a passage of the three-way valve 19, the through hole 3 is in communication with either the vacuum pump 17 or the pure water reservoir 20. Prior to polishing of the substrate 1, the through hole 3 is arranged to be in communication with the vacuum pump 17, and hence the substrate 1 is vacuum-chucked to the substrate holder 2 at its surface 2*a*, as illustrated in FIG. 2.

A guide ring 4 composed of plastics is fixedly secured to the substrate holer 2 at its periphery by means of screws 5 (only one of them is illustrated in FIGS. 2A to 2C). The guide ring 4 has an inner diameter slightly greater than an outer diameter of the substrate 1, and hence the substrate 1 is surrounded at its circumference by the guide ring 4.

Between the guide ring 4 and the substrate holder 2 is interposed a ring-shaped silicon rubber 6 having a thickness in the range of 0.5 mm to 5 mm. Thus, the guide ring 4 is slightly movable vertically relative to the substrate holder 2. Natural rubber or synthetic rubber may be substituted for the silicon rubber 6.

A disc plate 7 composed of stainless steel and having the same outer diameter as that of the substrate holder 2 is fixedly secured to the substrate holder 2 by means of screws 5*a*.

The screws 5 for fixedly securing the guide ring 4 to the substrate holder 2 are embedded in the substrate holder 2, and thus there exists a space 21 above a head of each of the screws 5 and below the stainless steel disc plate 7. Hence, even if the guide ring 4 vertically, slightly moves because of the silicon rubber film 6, the head of the screw 5 does not hit the stainless steel disc plate 7. Though only one screw 5 is illustrated in FIGS. 2A to 2C, a total of four screws 5 are used to secure the guide ring 4 to the substrate holder 2. However, the number of the screws 5 is not limited.

The silicon rubber 6 ensures that the guide ring 4 is not broken even if the substrate 1 exerts instantaneous stress on the guide ring 4 while the substrate 1 is being polished.

The stainless steel disc plate 7 to which the substrate holder 2 is fixedly secured has a rotation shaft 8 which is in mechanical communication with a motor 22. The motor 22 rotates the rotation shaft 8, the stainless steel disc plate 7, the substrate holer 2, and hence the substrate 1. To the rotation shaft 8 is secured a joint (not illustrated) for keeping the surface 2*a* of the substrate holder 2 in parallel with a top surface of the surface table 10.

When the substrate 1 is to be polished, the substrate holder 2 is rotated through the stainless steel disc plate 7 to which the rotation shaft 8 is secured, and then the substrate 1 is compressed onto the surface table 10 on which the polishing cloth 9 is lying. The substrate holder 2 rotates at the same r.p.m. as that of the surface table 10, within the range of 10 to 50 r.p.m. The substrate 1 is compressed onto the surface table 10 with a pressure in the range of 0.2 to 0.5 $kg/cm^2$.

At the same time when the substrate holder 2 is lowered and the substrate 1 comes to contact with the polishing cloth 9 composed of polyurethane, the three-way valve 19 shuts off a passage 23*a* for communicating the through hole 3 of the substrate holder 2 to the vacuum pump 17, and opens a passage 23*b* for communicating the through hole 3 to the pure water reservoir 20. Thus, pure water is supplied to the through hole 3 of the substrate holer 2, thereby there is formed a flowing liquid layer 12 between the substrate 1 and the surface 2*a* of the substrate holder 2, as illustrated in FIG. 2B. The thus formed flowing liquid layer 12 flows from an outlet of the divisional hole 3*a* towards a center of the substrate 1 and also towards the edge of the substrate 1, thereby between the substrate holder 2 and the substrate 1 is filled with the flowing liquid layer 12. The substrate 1 is held relative to the substrate holder 2 by surface tension of the flowing liquid layer 12 with a small gap being present between the substrate 1 and the substrate holder 2, in which gap the liquid layer 12 is flowing.

Before polishing, process liquid is introduced into the polishing cloth 9. The process liquid composed of slurry containing silica particles scattered therein in the range of 10 wt % to 30 wt %. The polishing of the substrate 1 is accomplished by chemical and mechanical reaction between the silica particles and an interlayer insulative layer of the substrate 1. If excessive pure water for forming the flowing liquid layer 12 is supplied, the process liquid is diluted with the result that a polishing speed is decreased. When a 6-inches substrate is to be polished, an appropriate volume of pure water is in the range of 2 to 20 ml/min. The volume of pure water to be supplied is dependent on a size of a substrate, an inner diameter and the number of the through holes 3, etc.

A divisional hole 3*a* may be formed at a center of the substrate holder 2, namely a divisional hole 3*a* may be formed so that the divisional hole 3*a* is in straight connection with the through hole 3. However, such a central divisional hole 3*a* slightly reduces the uniform distribution of the flowing liquid layer 12 over the substrate 1. Accordingly, it is preferable to arrange the divisional holes 3*a* at any position other than a center position of the substrate 1. The through holes 3 and divisional holes 3*a* may have any cross-sectional shape such as a circle, a rectangle, a triangle and an oval.

The through hole 3 has a cross-sectional area equal to a total cross-sectional area of the divisional holes 3*a*. However, it is preferable for the through hole 3 to have a greater cross-sectional area than the total cross-sectional area of the divisional holes 3*a* in order to provide pure water to each of the divisional holes 3*a* with less resistance.

There occurs no friction between the substrate 1 and the substrate holder 2 due to the presence of the flowing liquid layer 12, and hence the substrate 1 is able to rotate within the guide ring 4. When the substrate holder 2 has the same r.p.m. as that of the surface table 10, the substrate 1 makes a planetary rotation within the guide ring 4. In addition, the flowing liquid layer 12 ensures that the substrate holder 2 exerts uniform pressure on the substrate 1 to thereby enhance polishing uniformity.

There always exists a water layer flowing between the substrate holder 2 and the substrate 1. Thus, even if there exists particles between the substrate 1 and the surface 2*a* of the substrate holder 2, such particles are discharged outside of the substrate 1 by the flow. In particular, since the flowing liquid layer is formed by supplying pure water through the divisional holes 3*a* reaching the surface 2*a* of the substrate holder 2 at a point spaced away from the edge of the substrate 1, and thus always forwards toward the edge of the substrate 1, slurry is not allowed to enter into a space between the substrate holder 2 and the substrate 1. Accordingly, no particles become dry and stick to a reverse surface of the substrate 1, and such particles do not degrade polishing uniformity. Thus, it is quite important to form the flowing liquid layer 12 between the substrate 1 and the substrate holder 2 by providing pure water through the through hole 3 of the substrate holder 2 while the substrate 1 is being polished. The flowing liquid layer 12 enhances the polishing uniformity of the substrate 1. In addition, since the liquid layer 12 flows towards the edge of the substrate 1, the process liquid does not reach the reverse surface of the substrate 1.

When the polishing after a certain period of time, has been completed, a load acting on the substrate holder 2 begins to be decreased. At the same time, the three-way valve 19 shuts off the passage 23*b* and open the passage 23*a*. Thus, pure water is no longer supplied to the through hole 3 of the substrate holder 2 from the pure water reservoir 20, and the substrate 1 is vacuum-chucked again through the through hole 3 and divisional holes 3*a* by the vacuum pump 17, as illustrated in FIG. 2C. Then, the substrate holer 2 is raised away from the polishing cloth 9 with the substrate 1 being vacuum-chucked thereto. Then, a polished surface of the substrate 1 is scrubbed with a sponge or a non-dust cloth to remove slurry therefrom. Finally, the three-way valve 19 shuts off the passage 23*a* to stop the supply of vacuum to the through hole 3. Thus, the substrate 1 becomes disjoined from the substrate holder 2. Pressurized air may be supplied through the through hole 3 and divisional holes 3*a* to expedite separation of the substrate 1 from the substrate holder 2. Then, the substrate 1 is fed to a transfer system (not illustrated).

The liquid flowing through the divisional holes 3*a* ensures that the inside of the divisional holes 3*a* never becomes dry. Thus, there is expected an advantage that contaminants such as particles of abrasive powder do not adhere to an inner wall of the divisional holes 3*a*.

Though the substrate holder 2 is composed of quartz in the embodiment, the substrate holder 2 may be-composed of other inorganic material such as sapphire, sintered alumina, silicon nitride and single crystal silicon. The substrate holder 2 can be composed of metal such as stainless steel, but it is not recommended because there is a concern that the substrate 1 may be contaminated with metal. The guide ring 4 is preferably composed of rigid polymer such as acrylics, polystyrene, Teflon and vinyl chloride. The guide ring 4 can be composed of ceramic such as sintered alumina, molten quartz, sapphire or single crystal silicon, but it is not recommended because the guide ring 4 may possibly be broken at its outer edge by contact with the substrate during the polishing of the substrate 1. The guide ring 4 can be composed of metal such as stainless steel, but it is not recommended because there is a concern that the substrate 1 and the polishing cloth 9 is contaminated with metal. Metal is not suitable for a material for the guide ring 4, in particular in the polishing of an interlayer insulative layer of the substrate on which a device is fabricated, because such polishing needs to be carried out with high accuracy.

Figure 4:
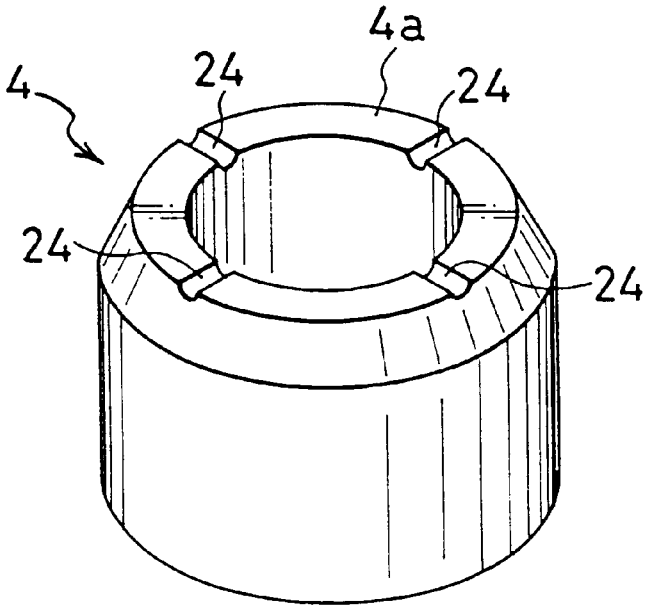
FIG. 4 is a perspective view illustrating an upside down view of the guide ring having grooves formed therewith.

As illustrated in FIG. 4, the guide ring 4 may be formed at a top surface 4*a* thereof with grooves 24 having a depth of approximately 1 mm for discharging the flowing liquid layer 12. The grooves 24 extend radially from a central axis of the guide ring 4. Though the illustrated guide ring 4 has four grooves 24, the number of the grooves 24 is not limited to four. Instead, the desired number of the grooves 24 may be formed. In addition, the illustrated grooves 24 are evenly spaced away from one another, but the grooves 24 may be randomly formed.

Figure 1A:
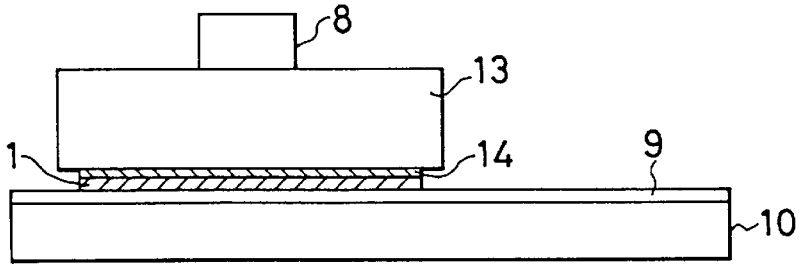
FIG. 1A PRIOR ART
FIGS. 1A, 1B, 1C and 1D are cross-sectional views of conventional apparatuses for polishing a semiconductor substrate.
Figure 1B:
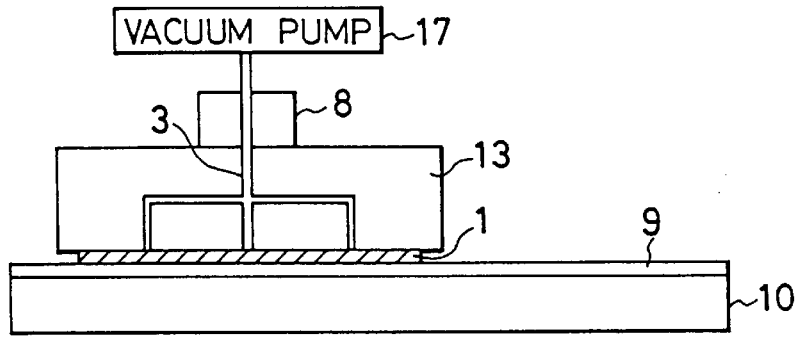
FIG. 1B PRIOR ART
Figure 1C:
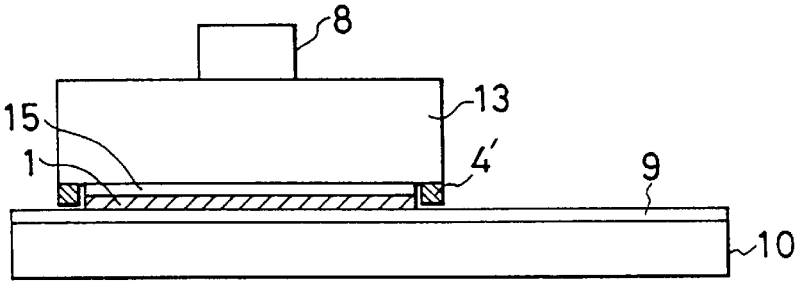
FIG. 1C PRIOR ART
Figure 1D:
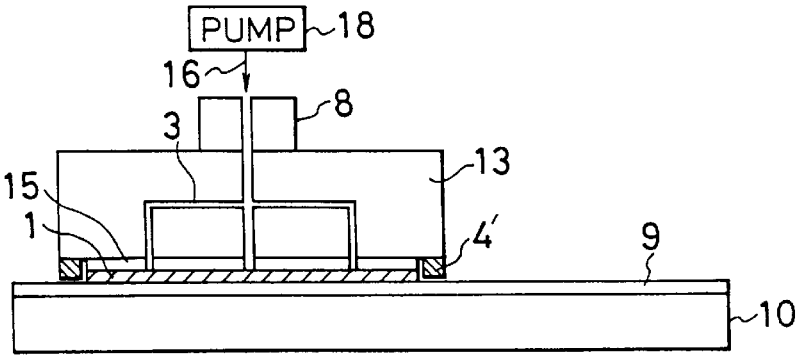
FIG. 1D PRIOR ART

Though a guide ring thinner than the substrate 1 may be directly secured to the substrate 1 holder by means of an adhesive such as epoxy, there is a concern that the substrate 1 may be broken when a great stress occurs in a moment between the guide ring and the substrate 1. Since the method in accordance with the invention forms the flowing liquid layer 12 between the substrate holder 2 and the substrate 1 while the substrate 1 is being polished, to thereby enable the substrate 1 to easily move or rotate like a planet, a frequency of the substrate 1 to come to contact with the guide ring 4 is greater than the conventional methods in which a substrate is vacuum-chucked (see FIG. 1B) or a substrate is attached to the substrate holder via a pad (see FIG. 1C). Accordingly, the use of an adhesive for securing the guide ring to the substrate holder is not recommended.

In the described embodiment, the flowing liquid layer 12 is composed of pure water. However, it should be noted that any liquid may be used only if the liquid contains no solid particles. For instance, an aqueous solution of an electrolyte such as ammonia salts may be used, as having been suggested by the inventors in Japanese Patent Application No. 6-17089 filed on Feb. 14, 1994, not yet laid open for public disclosure. Such an aqueous solution of an electrolyte has a function of agglomerating silica slurry to large particles, to thereby facilitate polishing of a substrate.

Another liquid for forming the flowing liquid layer 12 which may be used is a weak acidic aqueous solution such as aqueous solution of acetate, dilute nitric acid, dilute hydrochloric acid and dilute sulfuric acid, or a weak alkaline aqueous solution such as dilute aqueous ammonia and aqueous solution of amine, and water with oxidizer such as $H_2O_2$. Organic solvent such as glycerine may be used.

Though an interlayer insulative layer or an oxide layer is polished in the above mentioned embodiment, material to be polished is not to be limited to that. For instance, material to be polished includes PSG, BPSG, polysilicon, single crystal silicon layer deposited by epitaxy, and metal such as Al, Mo and W. The method and apparatus in accordance with the invention can be applied to a surface composed of a mixture of an insulative layer and metal or a mixture of an insulative layer and silicon. The method and apparatus is also effective for polishing a silicon substrate.

As having been described, in the apparatus for polishing a semiconductor substrate in accordance with the invention, liquid is provided between the substrate holder and a reverse surface of the substrate to thereby form a flowing liquid layer. The flowing liquid layer ensures that the substrate can be easily rotated while the substrate is being polished to thereby enhance uniformity of polishing the substrate. In addition, the flowing liquid layer protects a reverse surface of the substrate from being damaged, and further prevents slurry of process liquid from reaching a reverse surface of the substrate to thereby prevent contamination of a reverse surface of the substrate due to particles of slurry.

The guide ring secured to the substrate holder at its periphery is able to slightly move a resilient material such as silicon rubber interposed between the guide ring and the substrate holder. Thus, even if the substrate comes in contact with the guide ring, and thus the guide ring exerts a great momentary stress on the substrate while the substrate is being polished, the substrate is not broken. It should be noted that the guide ring may be secured directly to the substrate holder without using a resilient material.

The through hole and divisional holes of the substrate holder is used to pass either pure water or vacuum therethrough. When the polishing is not carried out, the substrate is vacuum-chucked through the through hole and divisional holes of the substrate holder to thereby make it easy to transfer the substrate and also to automate a sequence of polishing steps consisting of transferring the substrate to the substrate holder, polishing the substrate, and transferring the substrate away from the substrate holder. As a result, a period of time necessary for carrying out a step for polishing a substrate can be shortened, and hence fabrication cost is lowered.

In addition, since the substrate holder is composed of inorganic material such as quartz, contamination of the substrate due to metal is prevented. Furthermore, since the flowing liquid layer is formed over a reverse surface of the substrate to thereby prevent slurry of process liquid from reaching a reverse surface of the substrate, it is possible to prevent contamination of a reverse surface of the substrate due to particles of process liquid. Accordingly, a step for washing the polished substrate can be readily carried out with the result that the cost for washing a polished substrate can be decreased.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A method for polishing a semiconductor substrate, said method comprising steps of:

(a) vacuum-chucking a semiconductor substrate at a reverse surface thereof to a substrate holder;

(b) providing process liquid into a polishing cloth arranged on a surface table opposed to a surface of said semiconductor substrate;

(c) compressing said semiconductor substrate onto said polishing cloth;

(d) stopping vacuum-chucking of said semiconductor substrate during a time period substantially-concurrent with said step (c); and (e) providing liquid to thereby form a flowing liquid layer between said semiconductor substrate and said substrate holder substantially concurrent with said steps (c) and (d), thereby supporting said semiconductor substrate between said semiconductor substrate and said substrate holder during said step (c) by surface tension of said flowing liquid layer.

2. An apparatus for polishing a semiconductor substrate, said apparatus comprising:

a substrate holder for holding a semiconductor substrate therewith, said substrate holder being formed with at least one through hole reaching a surface thereof;

a surface table opposed to said substrate holder surface;

a polishing cloth arranged on said surface table for polishing the substrate;

means for providing a vacuum through said through-hole;

means for providing a liquid through said through-hole concurrent with said polishing cloth polishing the substrate; and means for providing pressurized gas during a substrate release from said substrate holder through said through-hole.

3. The apparatus as recited in claim 2 wherein said means for providing a vacuum, said means for providing a liquid and said means for providing a pressurized gas comprises a three-way valve.

4. The apparatus as recited in claim 2 further comprising a motor for rotating said substrate holder and said semiconductor substrate.

5. The apparatus as recited in claim 2, wherein said liquid comprises pure water containing no solid.

6. The apparatus as recited in claim 2, wherein said liquid comprises an aqueous solution of electrolyte containing no solid.

7. The apparatus as recited in claim 2, wherein said liquid comprises an organic solvent containing no solid.

8. The apparatus as recited in claim 2, wherein said substrate holder is formed with a plurality of through holes each of which reaches said surface of said substrate holder at a position spaced away from an edge of said semiconductor substrate.

9. The apparatus as recited in claim 2 further comprising a guide ring having an inner diameter greater than an outer diameter of said semiconductor substrate, said guide ring being bonded to said substrate holder and surrounding said semiconductor substrate.

10. The apparatus as recited in claim 9 further comprising a film composed of a resilient material, said film being interposed only between said substrate holder and said guide ring.

11. The apparatus as recited in claim 9, wherein said guide ring is formed at a bottom surface thereof with at least one radially extending groove.

12. The apparatus as recited in claim 2, wherein said surface of said substrate holder is comprises an inorganic material.

13. The apparatus as recited in claim 12, wherein said inorganic material includes single crystal silicon, sapphire, diamond, quartz, glass, sintered aluminum oxide, and sintered silicon nitride.

14. An apparatus according to claim 2 further comprising:

means for applying said polishing cloth against the substrate while held in said substrate holder.

* * * * *